US005169147A

United States Patent [19]

Hamano

[11] Patent Number: 5,169,147

[45] Date of Patent: Dec. 8, 1992

[54] STOP-CONTROL DEVICE OF ROTARY GAMING MACHINE

[75] Inventor: Junichi Hamano, Osaka, Japan

[73] Assignee: Takasago Electric Industry, Co., Ltd., Osaka, Japan

[21] Appl. No.: 769,097

[22] Filed: Sep. 30, 1991

[30] Foreign Application Priority Data

Dec. 29, 1990 [JP] Japan ..... 2-416891

[51] Int. Cl.[5] ..... A63F 5/04

[52] U.S. Cl. ..... 273/138 A; 273/143 R

[58] Field of Search ..... 273/138 A, 142 B, 143 R

[56] References Cited

U.S. PATENT DOCUMENTS 4,353,554 10/1982 Fisher ..... 273/138 A X
4,858,932 8/1989 Keane ..... 273/143 R
5,010,995 4/1991 Okada ..... 273/138 A X

*Primary Examiner*—William H. Grieb
*Attorney, Agent, or Firm*—Jordan and Hamburg

[57] ABSTRACT

The present invention relates to a stop-control device of a rotary gaming machine used for controlling the stop action of a rotor such as a reel in a rotary gaming machine such as a slot machine. In the rotary gaming machine, a table for allocating the symbol combination mode of the rotors against the combination of codes is stored in memory means. When starting the game, after generating a plurality of any codes from code generating means, stop-control means specifies the symbol combination mode corresponding to the combination of codes generated by the code generating means referring to the memory means, and allocates the symbols to respective rotors which are stopped at a predetermined position. According to such a configuration, in order to change the probability of appearance of the symbol combination mode, it is just necessary to change the content of the table stored in the memory means, or an allocation of the symbol combination mode of the rotors against the combination of codes, thus the probability of appearance can be changed with a very simple operation.

2 Claims, 12 Drawing Sheets

| | COMBINATION MODE | APPEARING PROBABILITY SET VALUE | APPEARING FREQUENCY | PAYOUT COINS | TOTAL PAYOUT COINS |
|---|---|---|---|---|---|
| 1 | 3×TC | 0.002 | 1 | 2000 | 2000 |
| 2 | 3×BC | 0.003 | 12 | 500 | 6000 |
| 3 | 3×RC | 0.100 | 39 | 100 | 3900 |
| 4 | 3×GC | 0.200 | 79 | 120 | 9480 |
| 5 | 3Mix C | 0.900 | 354 | 80 | 28320 |
| 6 | 3×3B | 0.200 | 79 | 80 | 6320 |
| 7 | 3×2B | 0.400 | 157 | 40 | 6280 |
| 8 | 3×1B | 0.800 | 315 | 20 | 6300 |
| 9 | 3Mix B | 6.000 | 2360 | 10 | 23600 |
| 10 | 2×C | 7.000 | 2754 | 6 | 16524 |
| TOTAL | | | 6150 | | 108724 |

FIG. 4

| | |
|---|---|
| 1 | T C |
| 2 | — |
| 3 | 1 B |
| 4 | — |
| 5 | 3 B |
| 6 | — |
| 7 | R C |
| 8 | — |
| 9 | 2 B |
| 10 | — |
| 11 | 1 B |
| 12 | — |
| 13 | B C |
| 14 | — |
| 15 | 2 B |
| 16 | — |
| 17 | 1 B |
| 18 | — |
| 19 | G C |
| 20 | — |
| 21 | 3 B |
| 22 | — |

FIG. 5

| | COMBINATION MODE | APPEARING PROBABILITY SET VALUE | APPEARING FREQUENCY | PAYOUT COINS | TOTAL PAYOUT COINS |
|---|---|---|---|---|---|
| 1 | 3×TC | 0.002 | 1 | 2000 | 2000 |
| 2 | 3×BC | 0.003 | 12 | 500 | 6000 |
| 3 | 3×RC | 0.100 | 39 | 100 | 3900 |
| 4 | 3×GC | 0.200 | 79 | 120 | 9480 |
| 5 | 3Mix C | 0.900 | 354 | 80 | 28320 |
| 6 | 3×3B | 0.200 | 79 | 80 | 6320 |
| 7 | 3×2B | 0.400 | 157 | 40 | 6280 |
| 8 | 3×1B | 0.800 | 315 | 20 | 6300 |
| 9 | 3Mix B | 6.000 | 2360 | 10 | 23600 |
| 10 | 2×C | 7.000 | 2754 | 6 | 16524 |
| TOTAL | | | 6150 | | 108724 |

FIG. 10

| COMBINATION AND NUMBER OF CODES | | 1 | 2 | 3 | 4 | | 10 | 11 |
|---|---|---|---|---|---|---|---|---|
| | | 80 | 70 | 50 | 40 | | 1 | 1 |
| 1 | 80 | $_{80}C_2$ | 80×70 | 80×50 | 80×40 | ..... | 80×1 | 80×1 |
| 2 | 70 | | $_{70}C_2$ | 70×50 | 70×40 | ..... | 70×1 | 70×1 |
| 3 | 50 | | | $_{50}C_2$ | 50×40 | ..... | 50×1 | 50×1 |
| 4 | 40 | | | | $_{40}C_2$ | ..... | 40×1 | 40×1 |
| 5 | 20 | | | | | | 20×1 | 20×1 |
| 6 | 10 | | | | | | 10×1 | 10×1 |
| 7 | 6 | | | | | | 6×1 | 6×1 |
| 8 | 2 | | | | | | 2×1 | 2×1 |
| 9 | 1 | | | | | | 1×1 | 1×1 |
| 10 | 1 | | | | | | | 1×1 |
| 11 | 1 | | | | | | | |

FIG. 11

| COMULATED VALUE | CODE COMBINATION | APPEARING FREQUENCY | SUM OF APPEARING FREQUENCY | CALCULATED VALUE OF APPEARING PROBABILITY | ALLOCATED SYMBOL COMBINATION |
|---|---|---|---|---|---|
| 1 | 1 × 1 | 80 C2 | 3160 | 8 0325369 | — |
| 2 | 1 × 2 | 80×70 | 5600 | 14.2348754 | — |
| 3 | 1 × 3 | 80×50 | 4000 | 10.1677682 | — |
| 4 | 1 × 4<br>2 × 2 | 80×40<br>70 C2 | 5615 | 14.2730046 | — |
| 5 | 1 × 5 | 80×20 | 1600 | 4.0671073 | 3 Mix B |
| 6 | 1 × 6<br>2 × 3 | 80×10<br>70×50 | 4300 | 10.9303508 | — |
| 7 | 1 × 7 | 80×6 | 480 | 1.2201322 | 2 Mix C |
| 8 | 1 × 8<br>2 × 4 | 80×2<br>50 C2 | 2960 | 7.5241484 | — |
| | | | | | |
| 30 | 3 ×10<br>5 × 6 | 50×1<br>20×10 | 250 | 0.6354855 | 3 × 1 B |
| | | | | | |
| 36 | 4 × 9<br>6 × 6 | 40×1<br>10 C2 | 85 | 0.2160651 | 3 × 1 B |
| | | | | | |
| 110 | 10×11 | 1×1 | 1 | 0.0025419 | 3 × T C |

FIG. 12

| 3Mix B | | | |
|---|---|---|---|
| 1 | 1 B | 2 B | 3 B |
| 2 | 1 B | 1 B | 2 B |
| 3 | 1 B | 1 B | 3 B |
| 4 | 1 B | 2 B | 2 B |
| 5 | 1 B | 3 B | 3 B |
| 6 | 2 B | 3 B | 3 B |
| | | | |

FIG. 13

| FIRST REEL | SECOND REEL | THIRD REEL |
|---|---|---|
| 1 B | 2 B | 3 B |
| 1 B | 3 B | 2 B |
| 2 B | 1 B | 3 B |
| 2 B | 3 B | 1 B |
| 3 B | 1 B | 2 B |
| 3 B | 2 B | 1 B |

FIG. 15

1

| | |
|---|---|
| 1 | TC |
| 2 | — |
| 3 | 1B |
| 4 | — |
| 5 | 3B |
| 6 | — |
| 7 | RC |
| 8 | — |
| 9 | 2B |
| 10 | — |
| 11 | 1B |
| 12 | — |
| 13 | BC |
| 14 | — |
| 15 | 2B |
| 16 | — |
| 17 | 1B |
| 18 | — |
| 19 | GC |
| 20 | — |
| 21 | 3B |
| 22 | — |

→

2

| | |
|---|---|
| 1 | TC |
| 2 | — |
| 3 | 1B |
| 4 | 1B |
| 5 | — |
| 6 | 3B |
| 7 | 3B |
| 8 | — |
| 9 | RC |
| 10 | RC |
| 11 | — |
| 12 | 2B |
| 13 | 2B |
| 14 | — |
| 15 | 1B |
| 16 | 1B |
| 17 | — |
| 18 | BC |
| 19 | BC |
| 20 | — |
| 21 | 2B |
| 22 | 2B |
| 23 | — |
| 24 | 1B |
| 25 | — |
| 26 | GC |
| 27 | GC |
| 28 | GC |
| 29 | GC |
| 30 | GC |
| 31 | — |
| 32 | 3B |
| 33 | 3B |
| 34 | — |

STOP-CONTROL DEVICE OF ROTARY GAMING MACHINE

FIELD OF THE INVENTION

The present invention relates to a stop-control device of a rotary gaming machine which is used to control device of rotary gaming machine which is used to control the stop action of a rotor such as a reel in the rotary gaming machine such as a slot machine.

DESCRIPTION OF THE PRIOR ART

In a conventional slot machine, there are provided three reels around the peripheral side surface of which a plurality of symbols are indicated. After inserting coins and starting all of the reels at once by operating a starting handle, each of the reels is stopped sequentially after a lapse of some predetermined time. As a result, either of the symbols on each of the reels appears on a predetermined stop line, thereby deciding the outcome of the game and the number of coins to be paid out by the symbol combination mode there of.

In a typical slot machine, for example, 22 symbols are provided for each of the reels, and in response to the probability of appearance of respective symbols, the number of coins to be paid out is decided.

In the conventional slot machine, though each of the reels is constituted by sticking a tape, onto which a predetermined number of symbols is printed, around the reel frame, in order to change the probability of appearance, a tape with different number of symbols must be sticked anew.

FIG. 15 (1) shows an example of symbol arrangements printed around the reel. In the case shown, a total number of symbols is 22, in which the symbols printed in "TC", "IB", "3B", . . . which are associated with the winning game and the symbols indicated in "—" which are unrelated with the winning game are included. When three reels having such symbol arrangements are provided, a total number of symbol combinations will be $22 \times 22 \times 22 = 10648$.

In such to change the probability of appearance in the slot machine in which the reel having such symbol arrangements are installed, for example, a reel having a different symbol arrangement as shown in FIG. 15 (2) must be installed. In the figure shown, since there is a total number of 34 symbols, a total number of symbol arrangements will be $34 \times 34 \times 34 = 39304$.

In order to change the probability of appearance, besides changing, practically, to the reel having the different number of symbols by renewing the tape on the reel, it is also possible to prepare a program with a virtual reel having such different number of symbols, and rotating the virtual reel virtually to stop either of the symbols on a virtual stop line. In this case, the reel is controlled to stop such that the symbols coincided with the symbols on the virtual stop line stop on the actual stop line.

In this method, however, whenever changing to the reel having the different number of symbols, it is necessary to prepare a virtual reel each time, resulting in a very complicated work.

BRIEF SUMMARY OF THE INVENTION

It is an object of the present invention to provide a stop-control device of a rotary gaming machine, wherein the probability of appearance of symbol combination modes can be changed freely by simple operation without renewing a tape or preparing a virtual reel.

In order to attain the aforesaid object, in the gaming machine of the present invention, there are provided memory means, code generating means and stop-control means.

In the memory means, a table for allocating the symbol combination modes of each of the rotors against the combination of codes is stored. The code generating means stores plural kinds and predetermined number of codes, and generates a plurality of any codes in response to the starting of games. The stop-control means specifies the symbol combination mode corresponding to the combination of codes generated by the code generating means referring to the memory means, and allocates the symbols to respective rotors which are stopped at a predetermined position.

BRIEF DESCRIPTION OF THE DRAWINGS

FIG. 4 is an explanatory view showing symbol arrangements indicated around the reel.

FIG. 5 is an explanatory view showing a method of setting the probability of appearance of symbol combination modes.

FIG. 10 is an explanatory view showing appearing frequencies with respect to respective combinations of two codes generated by a code generator.

FIG. 11 is an explanatory view showing a method of allocating the symbol combination mode against the combination of respective codes.

FIG. 12 is an explanatory view showing a specific example of a combination selecting table.

FIG. 13 is an explanatory view showing a specific example of a symbol allocation table.

FIG. 15 is an explanatory view showing a conventional method of changing the probability of appearance.

DESCRIPTION OF THE PREFERRED EMBODIMENTS

Figure 1:
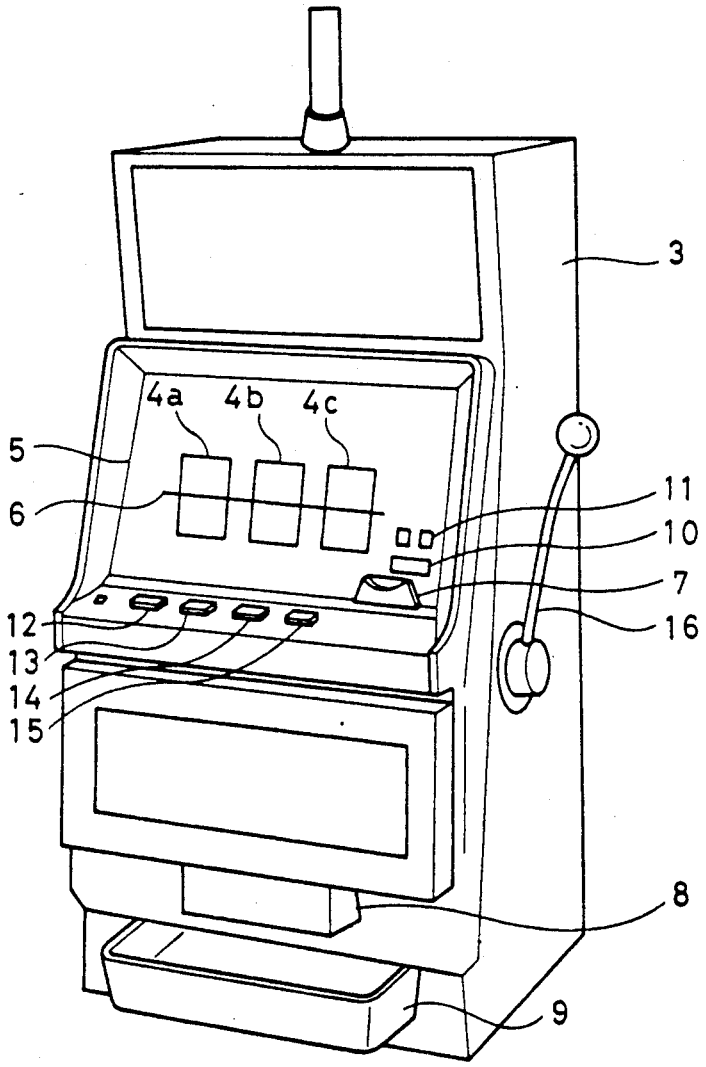
FIG. 1 is a perspective view showing an appearance of a slot machine in which the present invention is embodied.

FIG. 1 shows an appearance of a slot machine embodying the present invention, wherein three reels 4*a*, 4*b* and 4*c* are contained and arranged in a machine body 3. On the peripheral surface of respective reels, a plurality of symbols as shown in FIG. 4 are indicated in a registered state, and through a front display window 5, the rotating state of respective reels and the symbols in three frames, at the standstill of reels, can be confirmed. In FIG. 4, "TC", "RC", "BC", "GC", "IB", "2B" and "3B" represent the symbols associated with the winning game and "—" represents the symbol unrelated with the winning game.

In the center of the display window 5, there is shown a stop line 6 whereon, at the standstill of the reels, one symbol is stopped per each reel, and the preceding and succeeding symbols are indicated at the upper and lower positions of the stop line 6.

In the figure, numeral 7 designates a coin inserting mouth, numeral 8 indicates a coin discharging port and numeral 9 designates a coin receiver for receiving the coins paid out.

In the slot machine shown, besides playing the game by inserting several coins into the coin inserting mouth 7 at each game, it is possible to play the game by using the coins which are deposited in advance in a large number from the coin inserting mouth 7. When two coins are inserted, the coins being allotted at the winning game are twice the set value, and when three coins are inserted the allotment will be three times the set value.

At the edge portion of the display window 5, a stock-coin display 10 and an insert-coin display 11 are provided, and under the display window 5 such switches as a clear-button switch 12, a start switch 13, a register-button switch 14 and a max. register-button switch 15 are disposed.

The stock-coin display 10 indicates the number of coins deposited in the machine, and the insert-coin display 11 indicates the number of coins inserted by pressing the register-button switch 14 or the max. register-button switch 15.

The register-button switch 14 instructs to insert the stock coins in such a manner that one stock coin is inserted by pressing the button once, two stock coins are inserted by pressing the button twice and three stock coins are inserted by pressing the button three times. The max. register-button switch 15 instructs to insert the maximum allowable number of stock coins (3 coins in this embodiment).

The clear-button switch 12 is used for clearing the coins and is operated such that, the stock coins indicated on the stock-coin display 10 are discharged into the coin receiver 9 from the discharge port 8. The game start switch 13 is used to start the game and is operated after inserting the coins such, all of the three reels 4*a*, 4*b* and 4*c* are rotated at once as same as the case of operating a start handle 16 on the side of the machine body.

Figure 2:
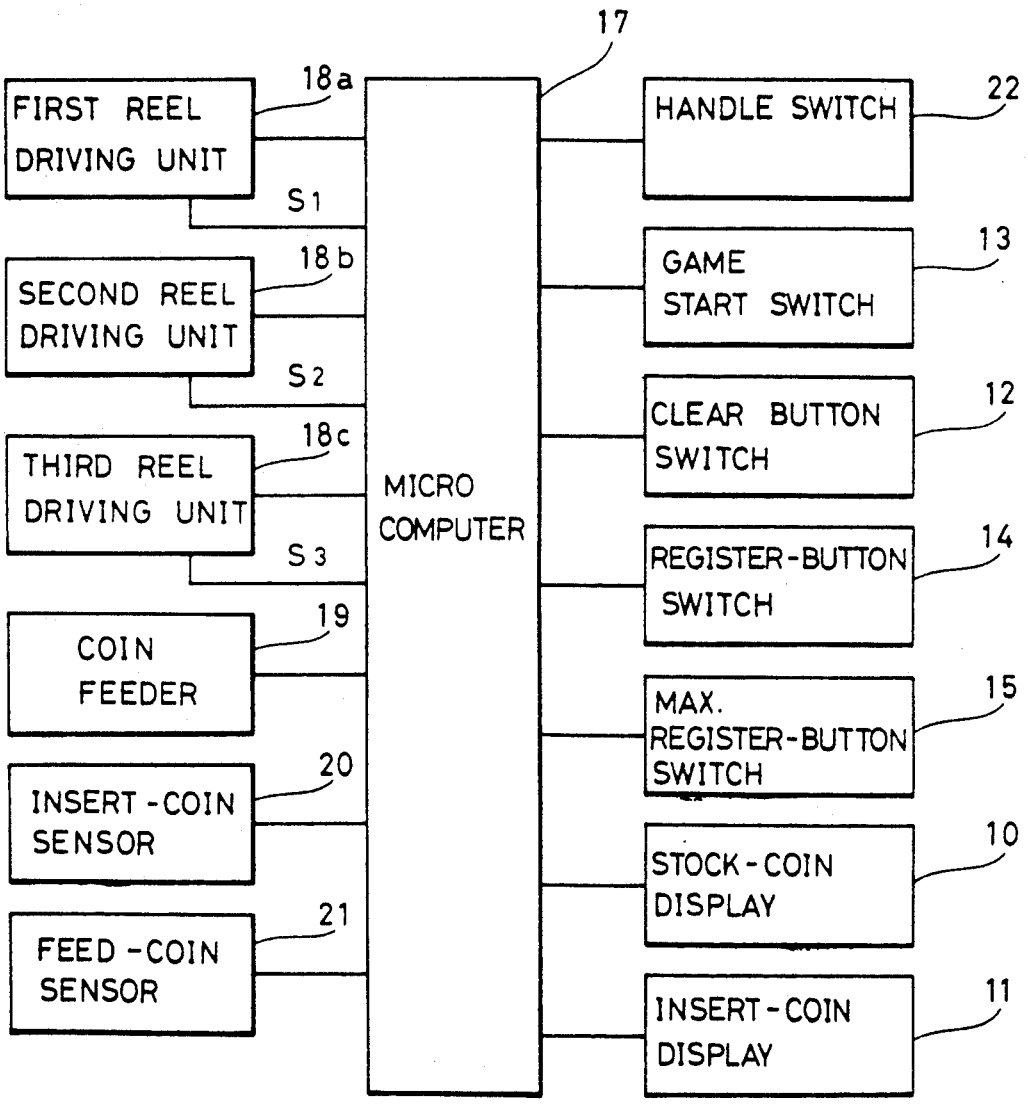
FIG. 2 is a block diagram showing a schematic circuit configuration of a slot machine.

FIG. 2 shows a schematic circuit configuration of a slot machine, in which in addition to driving units 18*a* to 18*c* of the first to third reels connected to a microcomputer 17, input/output devices of a coin feeder 19, an insert-coin sensor 20, a discharge-coin sensor 21, a handle switch 22, the game start switch 13, clear-button switch 12, register-button switch 14, max. register-button switch 15, stock-coin display 10 and insert-coin display 11 are also connected thereto.

The reel driving units 18*a* to 18*c* include stepping motors as driving sources of the reels 4*a*, 4*b*, 4*c*, and the microcomputer 17 applies driving pulses to the stepping motors to operate them. The microcomputer 17 counts the driving pulses and resets the count value by reference signals S1, S2, S3 indicating the reference positions of the reels to detect the symbols positioned on the stop line 6.

The coin feeder 19 conveys the coins to be discharged or to be cleared to the discharge port 8. The insert-coin sensor 20 detects the coins inserted through the inserting mouth 7, and the discharge-coin sensor 21 detects the coins fed by the coin feeder 19. The handle switch 22 is switched on by operating the start handle 16.

Figure 3:
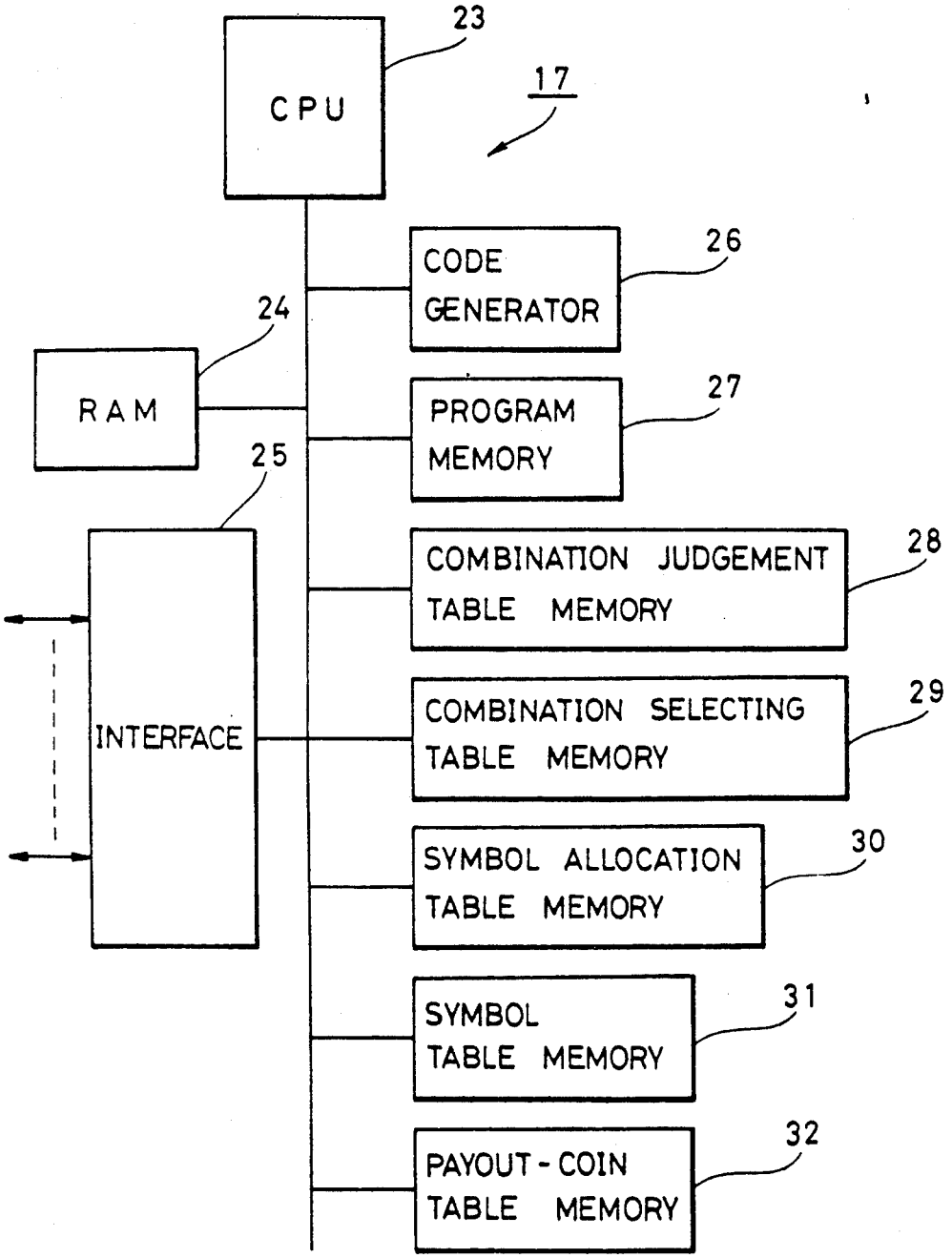
FIG. 3 is a block diagram showing a schematic configuration of a microcomputer.

FIG. 3 shows a schematic configuration of the microcomputer 17. In the figure, a CPU 23 is a main unit for control and operation and is designed to read and execute programs stored in a program memory 27, and while reading and writing data for a RAM 24, execute various controls related to the proceedings of game and payment of coins. The CPU 23 and the input-output devices are connected through an interface 25.

A code generator 26, to be described later in detail, respectively stores a predetermined number of eleven kinds of codes indicated at "1" to "11", and generates any of two codes in response to the starting of the game. A combination judgement table memory 28 stores a table for allocating the symbol combination modes of respective reels 4*a*, 4*b* and 4*c* against the two-code combinations.

The CPU 23, after specifying the symbol combination mode corresponding to the combination of two codes generated by the code generator 26 referring to the combination judgement table memory 28, by making reference to a combination selecting table memory 29, a symbol allocating table memory 30 and a symbol table memory 31, allocates the symbols to each of the reels 4*a*, 4*b* and 4*c*, which are stopped on the stop line 6, and at the same time, decides the coins to be discharged at the winning game referring to a discharge-coin table memory 32.

Figure 6:
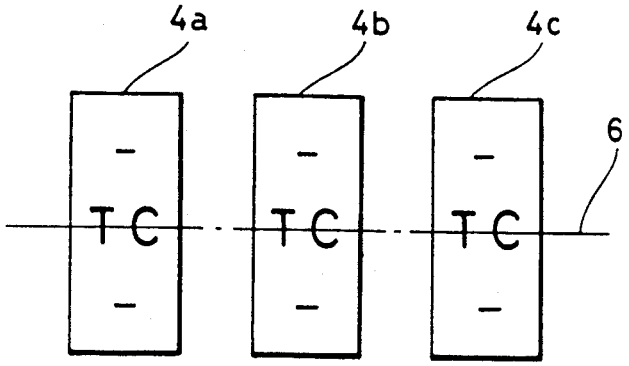
FIG. 6 is an explanatory view showing a specific example of symbols registered on a stop line.

FIG. 5 shows a method of setting the symbol combination mode associated with the winning game and the probability of appearance of respective combination modes. In the figure, "3×TC" shows the case wherein the symbol "TC" of the reels 4*a*, 4*b*, 4*c* are registered on the stop line 6 as shown in FIG. 6, a set value of the probability of appearance of this combination mode is "0.002%".

"3×BC" shows the case wherein the symbol "BC" of the reels 4*a*, 4*b* and 4*c* are aligned on the stop line 6. Similarly, "3×RC" shows the case wherein the symbol "RC" are aligned on the stop line 6, with "3×GC" also showing the case wherein the symbol are aligned, "3×2B" the case wherein the symbol "2B" are aligned and "3×1B" the case wherein the symbol "1B" are aligned on the stop line 6, respectively set values of the probability of appearance being "0.003%", "0.100%", "0.200%", "0.200%", "0.400%" and "0.800%".

Figure 7:
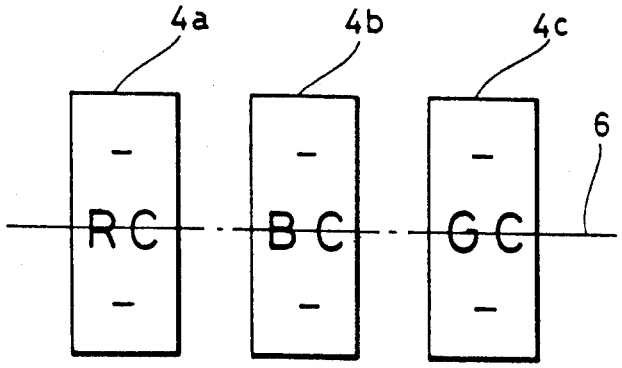
FIG. 7 is an explanatory view showing a specific example of symbols registered on a stop line.
Figure 8:
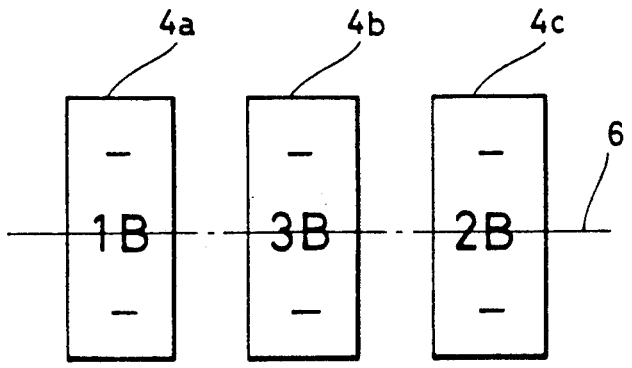
FIG. 8 is an explanatory view showing a specific example of symbols registered on a stop line.
Figure 9:
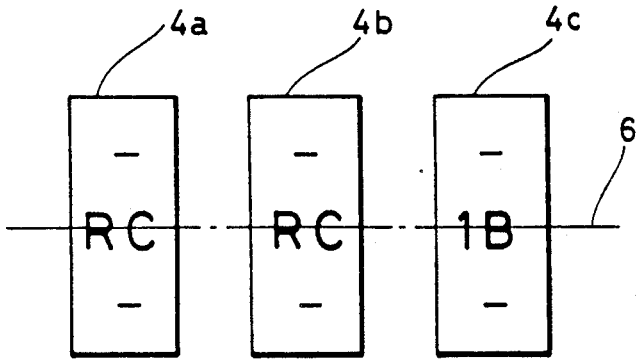
FIG. 9 is an explanatory view showing a specific example of symbols registered on a stop line.

"3 MIX C" shows the case wherein either of "RC", "BC" and "GC" is mixed and aligned on the stop line 6 as shown in FIG. 7, "3 MIX B" shows the case wherein either of "1B", "2B" and "3B" is mixed and aligned on the stop line 6 as shown in FIG. 8, respective set values of the probability of appearance are "0.900%" and "6.00%". Furthermore, "2×C" shows the case wherein two same symbols among "TC", "RC", "BC" and "GC" are aligned on the stop line 6 as shown in FIG. 9, a set value of the probability of appearance is "7.00%".

FIG. 10 shows the number of codes "1" to "11" stored in the code generator 26, combinations of two codes generated by the code generator 26 and the appearing frequency of respective combinations. In the code generator 26 of the embodiment, the code "1" is stored by 80, the code "2" by 70, the code "3" by 50, the code "4" by 40, the code "5" by 20, the code "6" by 10, the code "7" by 6, the code "8" by 2 and the codes "9", "10", and "11" by one each.

In the figure, for example, the frequency of extracting (appearing frequency) two code "1" is $_{80}C_2$, the frequency of extracting the code "1" and code "2" is 80×70. A total appearing frequencies for the combination of all of the codes is 39340.

Now, referring to FIG. 5, the number of appearances is obtained by multiplying the total appearing frequencies by the percentage of set value of the probability of appearance. For example, as to the symbol combination mode of "3×TC", the number of appearances is 39340×(0.002/100)=0.7874 or "1" by raising below decimal point.

The number of coins to be discharged indicates the number of coins discharged at the appearance of respective symbol combination modes, and the total number of coins to be discharged indicated the value obtained by multiplying the number of coins to be discharged by the number of appearances. For example, in the case of symbol combination mode of "3×TC", the number of coins to be discharged is set to 2000, thus the total number of coins to be discharged is 2000×1=2000.

FIG. 11 shows the appearing frequencies, sum of the appearing frequencies and calculated value of the probability of appearance for the cumulated value of respective code combinations. For example, the combination of codes whose cumulated value is "4" is the cases of the frequencies are respectively 80×40 and $_{70}C_2$, and the sum of appearing frequencies is 5615 which is obtained by adding the two. The calculated value of the probability of appearance is obtained by multiplying the sum of appearing frequencies/total appearing frequencies (39340) by 100(%).

Comparing the calculated value of the probability of appearance (FIG. 11) and the set value of the probability of appearance (FIG. 5), the symbol combination modes of respective reels 4*a*, 4*b* and 4*c* are allocated against the cumulated value of the code combinations.

For example, though the set value of the probability of appearance for the symbol combination mode "3×TC" is "0.002%" as shown in FIG. 5. An approximate calculated value of the probability of appearance is "0.0025419%" for the cumulated value "110" of the combination of codes "10" and "11". Then, the symbol combination mode "3×TC" is allocated to the cumulated value "110". Thereby, when the codes generated by the code generator 26 are "10" and "11", the symbol combination mode of the reels 4*a*, 4*b* and 4*c* to be stopped on the stop line 6 is specified as "3×TC".

Also, for example, though the set value of the probability of appearance for the symbol combination mode "3×IB" is "0.800%" as shown in FIG. 5, an approximate calculated value of the probability of appearance is the sum "0.8515506" of "0.6354855%" for the simulated value "30" of the combination of codes "3", "10" and the combination of codes "5", "6", and "0.2160651%" for the cumulated value "36" of the combination of codes "4", "9" and the combination of code "6", "6". Then, the symbol combination mode "3×IB" is allocated against the cumulated values "30" and "36".

Tables for allocating the symbol combination mode of the reels 4*a*, 4*b* and 4*c* against such two-code combinations are stored in the combination judgement table memory 29 shown in FIG. 3.

In order to realize the symbol combination mode specified by making reference to the combination judgement table memory 29 physically, the symbols are allocated to the reels 4*a*, 4*b* and 4*c* which are stopped on the stop line 26, by making reference to the combination selecting table memory 29, symbol allocation table memory 30 and the symbol table memory 31 shown in FIG. 3 as required.

FIG. 12 shows a specific example of a table stored in the combination selecting table memory 29. The example shown is the table for the symbol combination mode "3 MIX B", all of the combinations constituting "3 MIX B" are stored in each area. Accordingly, when the symbol combination mode specified by making reference to the combination judgement table memory 29 is "3 MIX B", the table of FIG. 12 is referred to and either of the combinations is selected optionally. This kind of table is naturally provided for the other symbol combination modes.

FIG. 13 shows a specific example of a table stored in the symbol allocation table memory,30. The example shown is the table for the combinations of "1B", "2B", "3B", the symbol allocating modes for the reels 4*a*, 4*b* and 4*c* are stored in each area. Accordingly, when the symbol combination selected by making reference to the combination selecting table memory 29 is "1B", "2B", "3B", the table of FIG. 13 is referred to and either of the allocating modes is selected optionally. This kind of table is naturally provided for the other symbol combinations.

When any of the symbols are allocated to the reels 4*a*, 4*b* and 4*c*, referring to the symbol table memory 31, it is transformed into position data for stopping the competent symbols on the stop line 6, and when calculated values of the driving pulses applied to the stepping motors of the reel driving units 18*a* to 18*c* coincide with the position data, the stepping motors are stopped.

Figure 14:
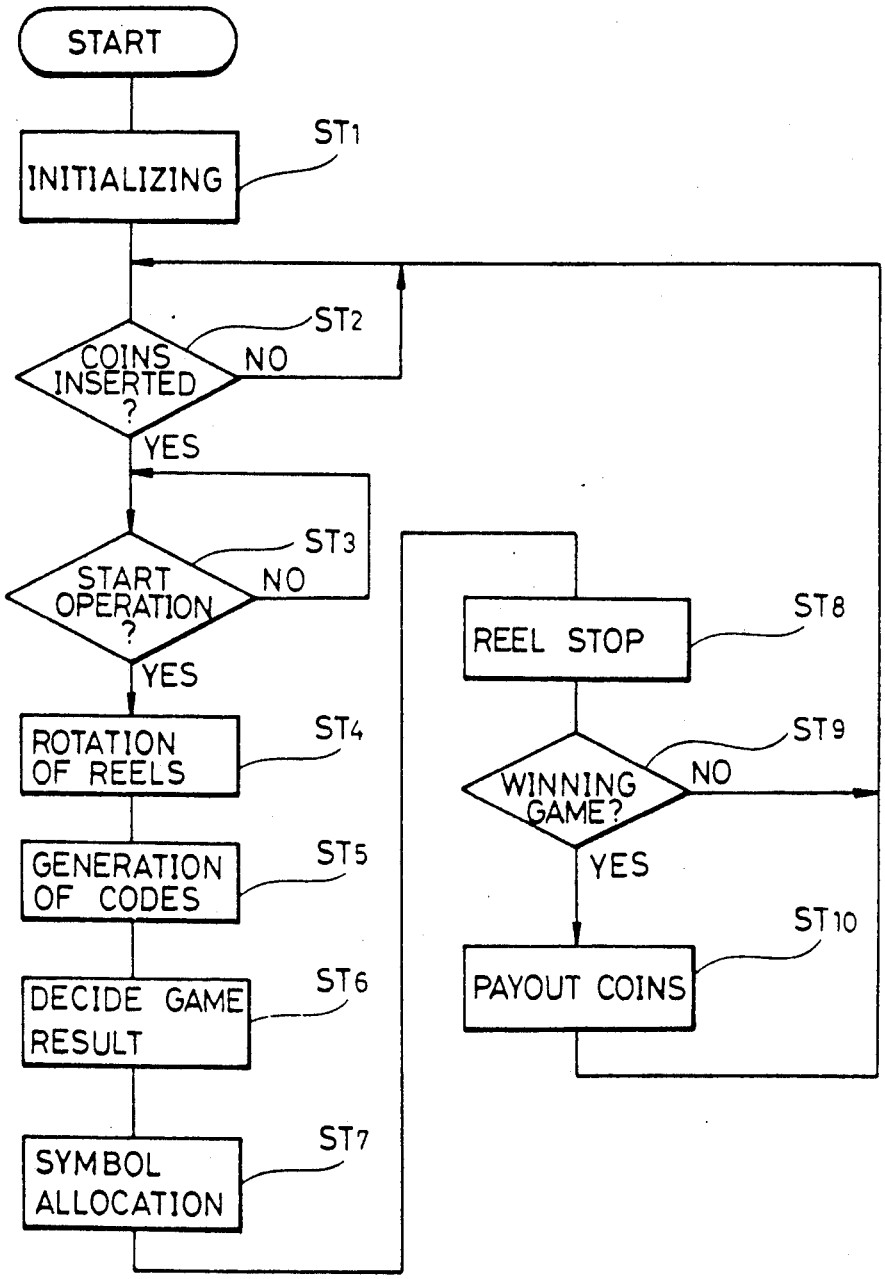
FIG. 14 is a flow chart showing controlling procedures of a CPU.

FIG. 14 shows controlling procedures of the CPU 23 for the slot machine constructed as aforementioned. In the figure, after initializing the contents of work areas of the RAM 24 and so on in Step 1, shown as "ST1", the CPU 23 judges whether the coin is inserted in Step 2, and in the following Step 3, judges whether the start handle 16 or the game start switch 13 is operated.

In case the results are "YES" in Steps 2, 3, the CPU 23, after rotating all of the three reels 4*a*, 4*b* and 4*c* at once, generates any two codes from the code generator 26 (Steps 4, 5). In the next Step 6, the CPU 23 judges the symbol combination mode corresponding to the combination of the two codes generated by the code generator 26 by referring to the symbol combination judgement table 29, thereby deciding the game result.

In case the result decided in Step 6 is the winning game, it is judged "YES" in Step 9 and the CPU 23 pays out a predetermined number of coins from the coin feeder 19 in response to the symbol combination mode with reference made to the coin table memory 32. After paying out the coins or in case it is judged "NO" in Step 9, the CPU 23 returns to Step 2 and stands by for the next game.

In Step 7, the CPU 23, by making reference to the combination selecting table memory 29, symbol allocation table memory 30 and symbol table memory 31 as required, allocates respective symbols to the reels 4*a*, 4*b* and 4*c*, and in the following step 8, referring to the symbol table memory 31, stops the reels 4*a*, 4*b* and 4*c* to rotate so that the symbols are stopped on the stop line 6.

As stated above, in the present invention, a table for allocating the symbol combination mode of the reels against the combination of codes is stored in a memory, and when starting the game, after generating a plurality of any codes by code generating means, stop-control means is designed to specify the symbol combination mode corresponding to the combination of codes generated by the code generating means referring to the memory means, and allocate the symbols to respective reels which are stopped at a predetermined stop position, so that in order to change the probability of appearance of the symbol combination mode, it is just necessary to change the content of the table stored in the memory means, or the allocation of the symbol combination mode of the reels against the code combination, thus the probability of appearance can be changed freely with a simple operation regardless of the number of symbols.

What is claimed is:

1. A stop-control device of a rotary gaming machine comprising a plurality of rotors onto which a plurality of symbols are indicated, the stop action of the rotors being controlled and any of the symbols being appeared at a predetermined position, said stop-control device further comprising, memory means, code generating means and stop-control means;

said memory means storing a table for allocating the symbol combination mode of the rotors against the combination of codes;

said code generating means storing plural kinds and predetermined number of codes, and generating a plurality of any codes in response to the starting of the game; and said stop-control means specifying the symbol combination mode corresponding to the combination of the codes generated by the code generating means referring to the memory means, and allocating the symbols to respective rotors which are stopped at a predetermined position.

2. A stop-control device of a rotary gaming machine as set forth in claim 1, wherein the rotor corresponds to a reel of a slot machine, three reels being disposed in a machine body at a position of display window.

* * * * *